US006367438B2

(12) United States Patent
Neller

(10) Patent No.: US 6,367,438 B2
(45) Date of Patent: Apr. 9, 2002

(54) ROTARY PISTON ADJUSTER FOR HYDRAULIC PHASE ADJUSTMENT OF A SHAFT RELATIVE TO A DRIVE PINION

(75) Inventor: Dieter Neller, Hirschaid (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

(21) Appl. No.: 09/846,012

(22) Filed: Apr. 30, 2001

(30) Foreign Application Priority Data

May 19, 2000 (DE) ..... 100 24 760

(51) Int. Cl.[7] ..... F01L 1/34

(52) U.S. Cl. ..... 123/90.17; 123/90.15; 74/568 R

(58) Field of Search ..... 123/90.12, 90.15, 123/90.17, 90.31; 74/568 R; 464/1, 2, 160

(56) References Cited

U.S. PATENT DOCUMENTS 5,848,565 A * 12/1998 Thoma ..... 91/491
6,247,434 B1 * 6/2001 Simpson et al. ..... 123/90.17

FOREIGN PATENT DOCUMENTS

DE 19745908 4/1999

* cited by examiner

*Primary Examiner*—Thomas Denion
*Assistant Examiner*—Jaime Corrigan
(74) *Attorney, Agent, or Firm*—Bierman, Muserlian and Lucas

(57) ABSTRACT

The invention concerns a rotary piston adjuster (1, 1') for hydraulic phase adjustment of a camshaft of an internal combustion engine relative to a drive pinion (6), said adjuster comprising a rotor (3, 3') fixed to the camshaft and cooperating with the drive pinion (6) for effecting phase adjustment. Due to the fact that annular hydraulic chambers (14, 14') are arranged in the peripheral region of the rotor (3, 3') and comprise an outer and an inner limiting wall (15, 15', 16) and radially extending vanes (18, 18') acting as separating walls, said hydraulic chambers (14, 14') being divided by segments (8, 8') that are axially connected to the drive pinion (6) into active oil chambers A and B with sealing clearance that can be loaded by pressure oil, and further due to the fact that the segments (8, 8') possess an anti-racing device and an eccentric pivot bearing (19) having radial play, a rotary piston adjuster is obtained that is simple to manufacture and to mount while being endowed with high efficiency and a high functional quality.

10 Claims, 4 Drawing Sheets

ROTARY PISTON ADJUSTER FOR HYDRAULIC PHASE ADJUSTMENT OF A SHAFT RELATIVE TO A DRIVE PINION

FIELD OF THE INVENTION

The invention concerns a rotary piston adjuster for hydraulic phase adjustment of a shaft relative to a drive pinion, said adjuster comprising a rotor fixed to the shaft and cooperating with the drive pinion for effecting phase adjustment. The invention relates more particularly to a rotary piston adjuster for hydraulic phase adjustment of an inlet camshaft of an internal combustion engine.

BACKGROUND OF THE INVENTION

U.S. Pat. No. 4,858,572 discloses a rotary piston adjuster which is configured as a vane-type adjuster and serves to hydraulically adjust the phases of a shaft relative to a drive pinion. This adjuster comprises an outer rotor that is driven by a crankshaft of an internal combustion engine and encloses hydraulic chambers that are divided by radially arranged vanes of an inner rotor fixed to the camshaft into sealed active oil chambers that can be loaded by pressure oil. The vanes are inserted into complementary slots of the inner rotor. The great number of individual components and the great amount of work involved in their fabrication increase the costs of manufacture of the adjuster. In addition, the narrow vanes cause considerable leakage losses.

DE 197 15 570 A1 likewise shows a rotary piston adjuster configured as a vane-type adjuster. The inner rotor of this adjuster, however, has particularly broad vanes that are pressed radially by centrifugal force and axially by spring force against the limiting walls of the hydraulic chambers. This minimizes leakage losses between the active oil chambers but increases the structural complexity of the adjuster.

Another vane-type adjuster is described in DE 196 23 818 A1. In contrast to the vane-type adjuster of the aforementioned document, this adjuster has vanes integrally formed on the inner rotor so that a one-piece component is obtained. Although this reduces the number of individual parts of the adjuster, more finishing work is required when manufacturing is done by sintering.

OBJECTS OF THE INVENTION

It is an object of the invention to provide a rotary piston adjuster for a hydraulic adjustment of phase positions of a shaft, and more particularly of an inlet camshaft of an internal combustion engine, relative to a drive pinion, which adjuster should be simple to manufacture and have low oil leakage.

This and other objects and advantages of the invention will become obvious from the following detailed description.

SUMMARY OF THE INVENTION

The invention achieves the above objects by the fact that annular hydraulic chambers are arranged in a peripheral region of the rotor and comprise an outer and an inner limiting wall and radially extending vanes acting as separating walls, said hydraulic chambers being divided by segments that are axially connected to the drive pinion into active oil chambers A and B with sealing clearance that can be loaded by pressure oil, said segments possessing an anti-racing device and an eccentric pivot bearing having radial play.

Particularly in comparison to a conventional vane-type adjuster, the rotary piston adjuster of the invention is simple to manufacture and to assemble because it has only a few, simple components.

The rotor and the vanes are made in one piece with one another. Therefore separate vanes and their slots, as also spring elements for tolerance compensation and as sealing aids, and their testing and mounting are not required. Due to the omission of the slots, the supply of oil to the active oil chambers is simplified and space is created for a larger number of vanes which enable a higher moment of adjustment, or the space requirement for the existing number of vanes is reduced.

An important advantage of the solution of the invention lies in the eccentric mounting of the segments. Due to the differential oil pressure of the active oil chambers A and B, a torque is applied to the segments that pivots them in the one or the other direction. The anti-racing device of the segments prevents them from racing under the action of this torque and causes them to come into contact with the outer and inner limiting walls of the hydraulic chambers.

Another important feature of the invention is the radial play of the pivot bearing that permits a non-constrained inclination or clamping of the segments between the limiting walls.

A great number of advantages with regard to permissible tolerances, simple inner mounting of the drive pinion, reduced oil leakage and natural self-locking or blocking of the segments are obtained by the eccentric mounting of the segments and their anti-racing device and by the radial play of the pivot bearings. In this way, positional and shape deviations of the limiting walls and the segments can be compensated for to a large extent by the self-regulating inclination of the segments. This enables a decrease of manufacturing work and the use of economic manufacturing methods such as extrusion molding of the rotors or cold drawing of the segments. Larger tolerances of the components can be bridged by grouping geometrically similar segments of other dimensions. In this way, the segments are generally independent of the dimensions of the hydraulic chambers.

The clearance-free contact of the segments effects their self-centering in the hydraulic chambers and thus leads to a clearance-free inner mounting of the drive pinion in the rotor without additional costs. This also considerably simplifies the assembly of the adjuster. Depending on the geometry of the segments, the inner mounting can be effected on the inner and/or outer limiting wall.

A further advantage of the clearance-free contact of the segments is the low leakage between the active oil chambers A and B. By this, with an unchanged oil pressure, the quantity of oil required and, if necessary, the size of the adjuster are reduced, while its efficiency is enhanced. This effect is also obtained with segments that do not have a geometry enabling self-locking.

The clearance-free contact of the segments also offers the possibility of a self-locking or blocking without additional components and costs. This self-locking or blocking prevents a reverse rotation of the inlet camshaft by its moment of drag and thus improves the response and adjusting behavior and raises the speed of adjustment. In addition, the adjuster can be operated at lower minimum adjusting pressures and with a smaller amount of oil and this can likewise lead to higher efficiency and smaller dimensions of the adjuster. By an appropriate pressurization of the segments with oil pressure, their self-locking can be released.

According to a further advantageous feature of the invention, the segments are configured longitudinally symmetrical and possess a plane of symmetry. This structure of the segments assures their functioning in both directions of pivot.

Advantageously, the segments comprise two identically shaped cams that are configured as an anti-racing device and arranged at equal distances to the plane of symmetry on at least one end of the segments, and a preferably central cam is arranged on the other end. When the segments pivot, the cams come into contact with the limiting walls. By the pressurization of the active oil chambers A and B with oil pressure, the segments pivot about their axis of pivot till one of the double cams comes into pressure contact with one of the limiting walls, and one point of the central cam situated on the other side of the plane of symmetry comes into pressure contact with the other of the limiting walls. Since the lines of contact of the cams are situated on different sides of the plane of symmetry and at a distance thereto, a racing of the segments is prevented and their clamping or wedging enabled. Advantageously, to achieve an inexpensive manufacture of the segments, the cams preferably have a circular cylindrical contour and the cylinder axis of the contour of the central cam preferably coincides with the axis of pivot of the segments.

The self-locking of the segments only takes place if the normals of the lines of contact between the cams and the limiting walls enclose an angle that brings about a self-locking. This angle is about 5° and is influenced by the distance between the cams.

Due to the fact that the cams and the pivot bearing are preferably arranged outside the central plane of the hydraulic chambers, the pivot bearings and their bearing bodies are offset towards the outside where they have more room.

According to still another advantageous feature of the invention, the hydraulic chambers are closed laterally with sealing clearance by a cover and by the drive pinion that is configured as a cover, and the cover and the drive pinion are connected to each other by a stator ring surrounding the rotor and by axle shafts of the pivot bearings. The cover, the drive pinion, the stator ring and the axle shafts together form an assembled stator that enables the formation of hydraulic chambers that are closed all round.

Advantageously, the axle shafts are preferably configured as through-screws that project through aligned bores of the cover and the drive pinion and brace these with a defined biasing force. In place of the through-screws that are also used in common-type adjusters, it is also possible to use bolts or rivets. The defined biasing force of the through-screws leads to a lateral play of about 5 $\mu$m. But it is also conceivable to transfer the biasing force of the through-screws to a bushing closely surrounding them and whose outer contour is configured as a bearing with radial clearance. Due to the larger tightening tolerances of the through-screws, the bushing would facilitate assembly but would require an additional clamping of the stator ring.

If the inner and the outer limiting walls are a part of the rotor, the hydraulic chambers of the rotor are closed on the outside. Such a rotor is sturdy and simple to manufacture and mount.

In an interesting alternative embodiment, the outer limiting walls of the hydraulic chambers are formed by the stator ring, and the free ends of the vanes of the rotor comprise recesses into which rollers are inserted with sealing clearance relative to the stator ring. In this way, a rotor is obtained having outwardly open hydraulic chambers that are closed by the stator ring. This enables a considerable reduction of the diameter of the rotor so that smaller and cheaper molds can be used in sinter molding. The inserted rollers fulfil the double function of supporting and sealing.

Further features of the invention can be gathered from the following description, claims and attached drawings in which examples of embodiment of the invention are schematically represented.

DETAILED DESCRIPTION OF THE DRAWINGS

Figure 1:
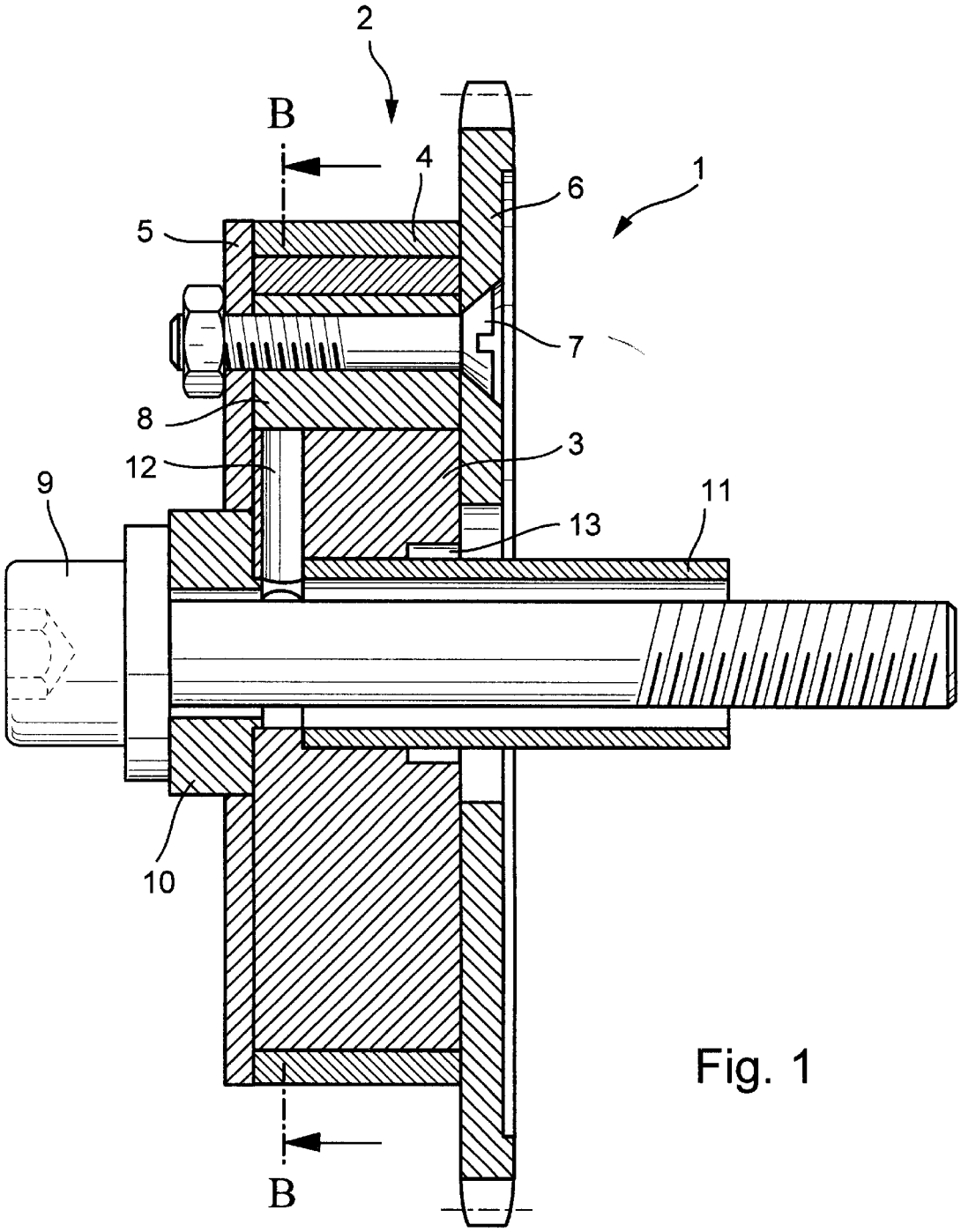
FIG. 1 is a longitudinal section taken along A—A of FIG. 2 through a segment-vane adjuster having an outwardly closed rotor.
Figure 2:
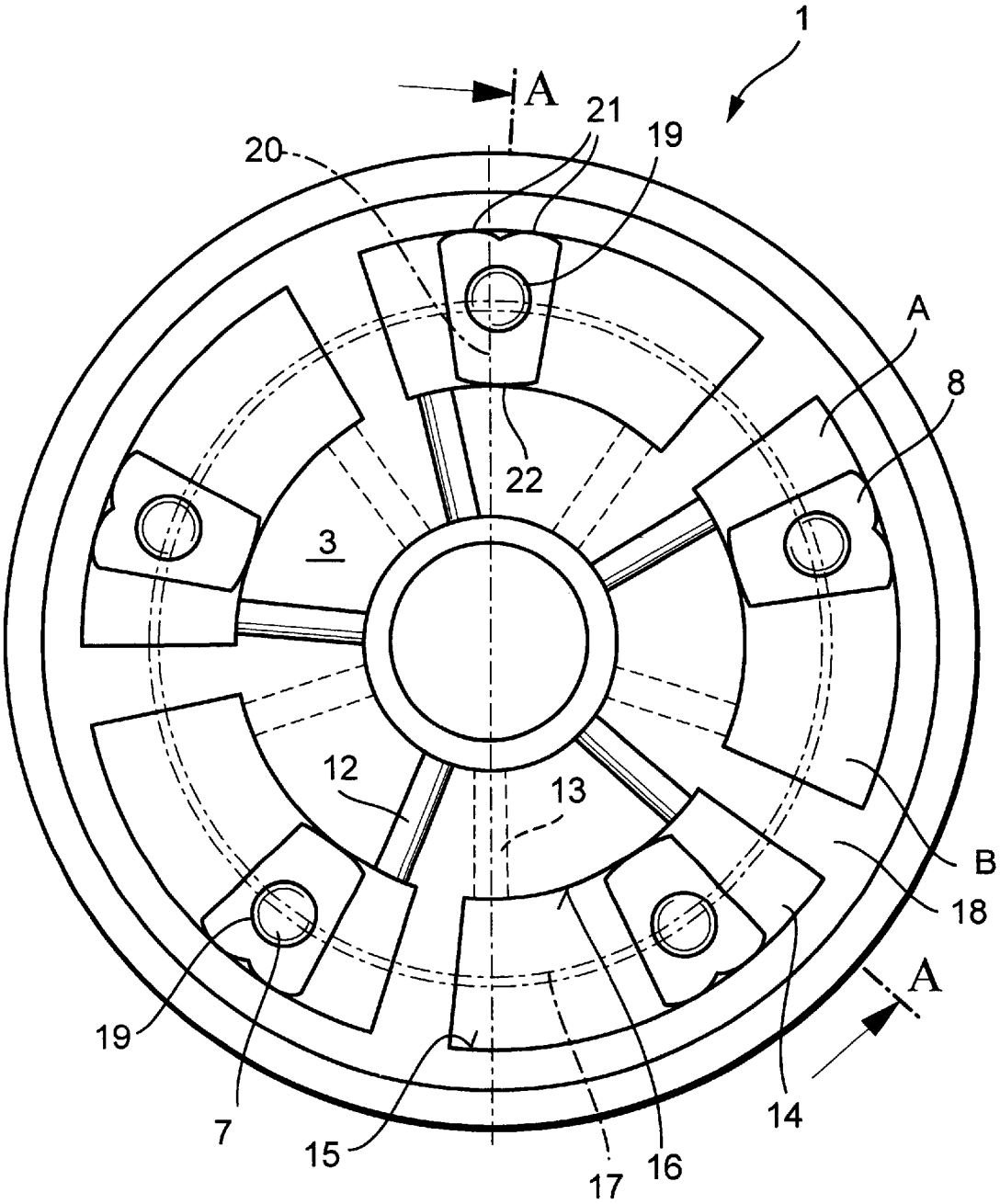
FIG. 2 is a cross-section taken along B—B of FIG. 1 through the segment-vane adjuster.

In FIG. 1, a segment-vane adjuster 1 comprising a stator 2 and a rotor 3 is shown in a longitudinal cross-section along A—A of FIG. 2.

The stator 2 is an assembled stator comprising a stator ring 4, a cover 5, a drive pinion 6, through-screws 7 and segments 8.

The drive pinion 6 is driven by a chain, not shown, of a crankshaft, not shown, of the internal combustion engine. Together with the cover 5, the drive pinion 6 serves to laterally close the rotor 3. The cover 5 and the drive pinion 6 are loaded by the through-screws 7 so that the stator ring 4 is constrained oil-tight between the cover 5 and the drive pinion 6, while the rotor 3 and the segments 8 have lateral sealing clearance. The segments 8 can pivot about the through-screws 7 and are mounted with radial play. They are thus axially connected to the drive pinion 6 and form a part of the assembled stator 2.

The rotor 3 is fixed rotationally fast on the camshaft, not shown, by a central screw 9 and a washer 10. A bushing 11 that engages into the rotor 3 and the camshaft serves to supply oil to the oil ducts 12, 13.

FIG. 2 shows a cross-section along B—B of FIG. 1 through the segment-vane adjuster 1. The rotor 3, that is surrounded with play by the stator ring 4, comprises in its peripheral region, annular hydraulic chambers 14 that are closed toward the periphery of the rotor 3 and comprise an outer and an inner limiting wall 15, 16 as also a central plane 17. The hydraulic chambers 14 are separated from one another by radially disposed vanes 18. The hydraulic chambers 14 themselves are divided by the segments 8 with sealing clearance into pressure oil-loadable active oil chambers A and B. The pressure oil is routed into the active oil chambers A and B through the oil ducts 12, 13.

In place of the annular hydraulic chambers 14, it is also conceivable to use chambers that extend spirally towards the center of the rotor 3. To accommodate to this, the pivot bearings of the segments 8 would have to be configured as slots. Such a solution would result in a variation of the adjusting moment over the range of adjustment.

The segments 8 that are pivotally mounted on the through-screws 7 possess pivot bearings 19 that are arranged outside of the center of the segments 8 and outside of the central plane 17 of the hydraulic chambers 14. Due to this eccentric bearing arrangement, the segments 8 are pivoted by the oil pressure in the active oil chambers A and B till they come into contact with the limiting walls 15, 16. A racing of the segments 8 is prevented by their special geometry which will be explained with reference to FIG. 3. Since the segments 8 have a longitudinally symmetrical configuration, i.e. they possess a plane of symmetry 20, their functioning is guaranteed in both directions of pivot.

An anti-racing device in the form of two cams 21 of identical configuration and arranged at equal distances to the plane of symmetry 20 is disposed on that end of the segments 8 that is closer to the axis of pivot. A central cam 22 is situated on the other end of the segments 8. All the cams 21, 22 have a circular cylindrical contour, the cylinder axis of the contour of the central cam 22 being the axis of pivot of the segments 8.

Figure 3:
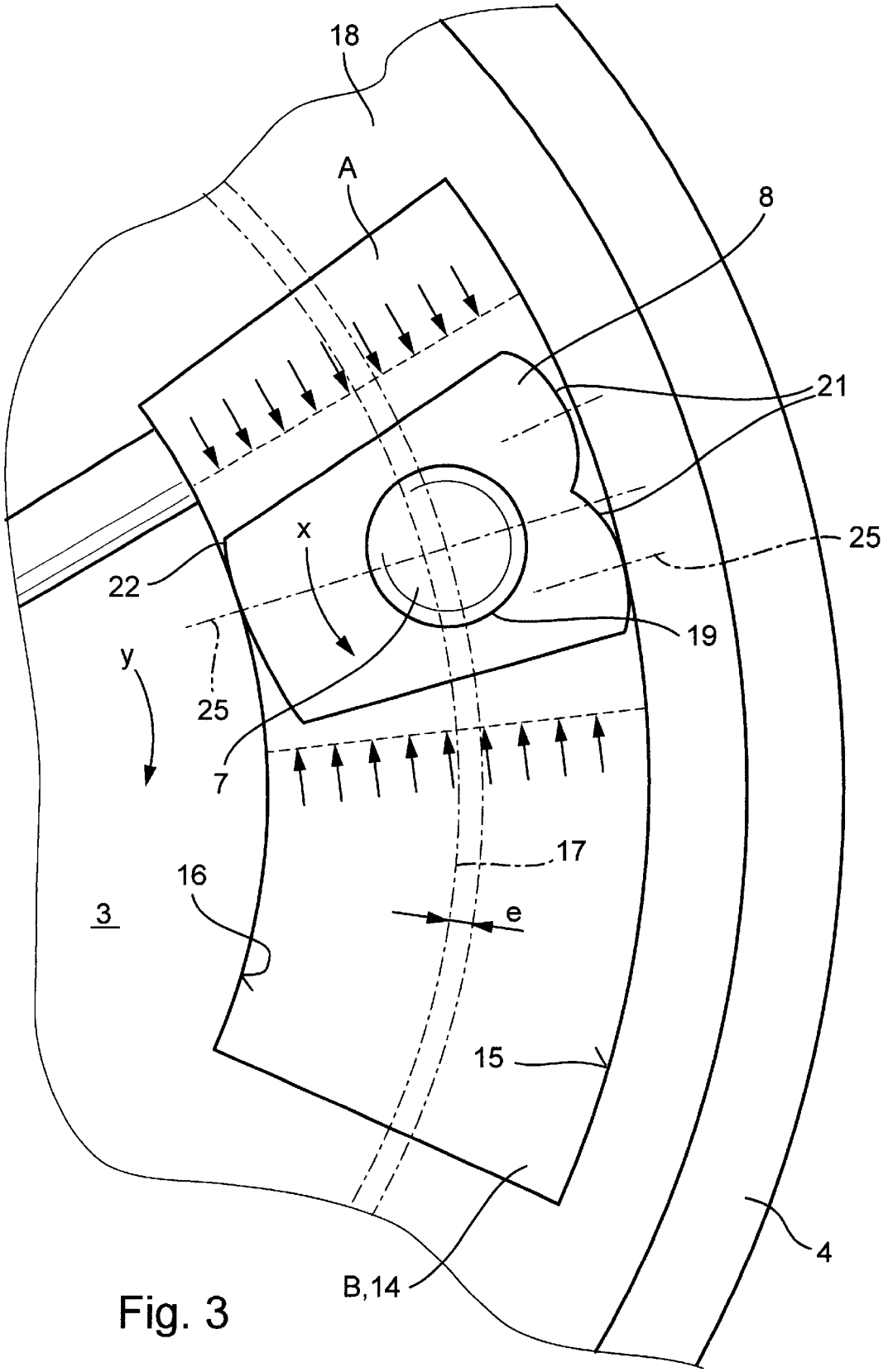
FIG. 3 is an enlarged cross-section through a hydraulic chamber of the rotor.

FIG. 3 shows an enlarged cross-section through a hydraulic chamber 14 of the rotor 3. A higher pressure prevails in the active oil chamber A than in the active oil chamber B. Due to the difference of pressure between the two chambers and the eccentricity "e" with which the pivot bearing 19 is arranged, the segment 8 is pivoted in the direction of the arrow X till it comes to abut with the right-hand cam 21 against the outer limiting wall 15. Due to the radial bearing clearance of the pivot bearing 19, the pressure of abutment of the cam 21 is transmitted to the central cam 22 so that this latter comes into unforced contact with the inner limiting wall 16.

The normals 25 of the line of contact of the right-hand cam 21 with the outer limiting wall and of the central cam 22 with the inner limiting wall are shown in FIG. 3. For achieving self-locking, the angle enclosed by these normals 25 should not exceed 5°. This angle is determined by the distance between the two cams 21.

The overpressure prevailing in the active oil chamber A causes the rotor 3 to rotate in anti-clockwise direction relative to the segment 8. Due to the contact pressure between the cams 21, 22 and the limiting walls 15, 16, the relative motion between the rotor 3 and the segments 8 causes opposing torques of different magnitude to act on the segment 8. The torque of the central cam 22 that acts on the longer lever arm opposes the torque produced by the oil pressure and thus prevents a wedging of the segments 8 during adjustment. The moment of drag of the camshaft acting in the direction of the arrow Y acts, in contrast, in the same direction as the arrow X and thus in the direction of the pivoting motion of the segment 8 produced by the oil pressure. The pivoting motion is thus augmented and leads to a wedging of the segment 8. In this way, a self-locking of the segment-vane adjuster of the invention relative to the moment of drag of the camshaft is obtained without additional measures. When the adjusting moment of the adjuster exceeds the moment of drag of the camshaft, this self-locking is released by the oil pressure in the active oil chamber A.

Figure 4:
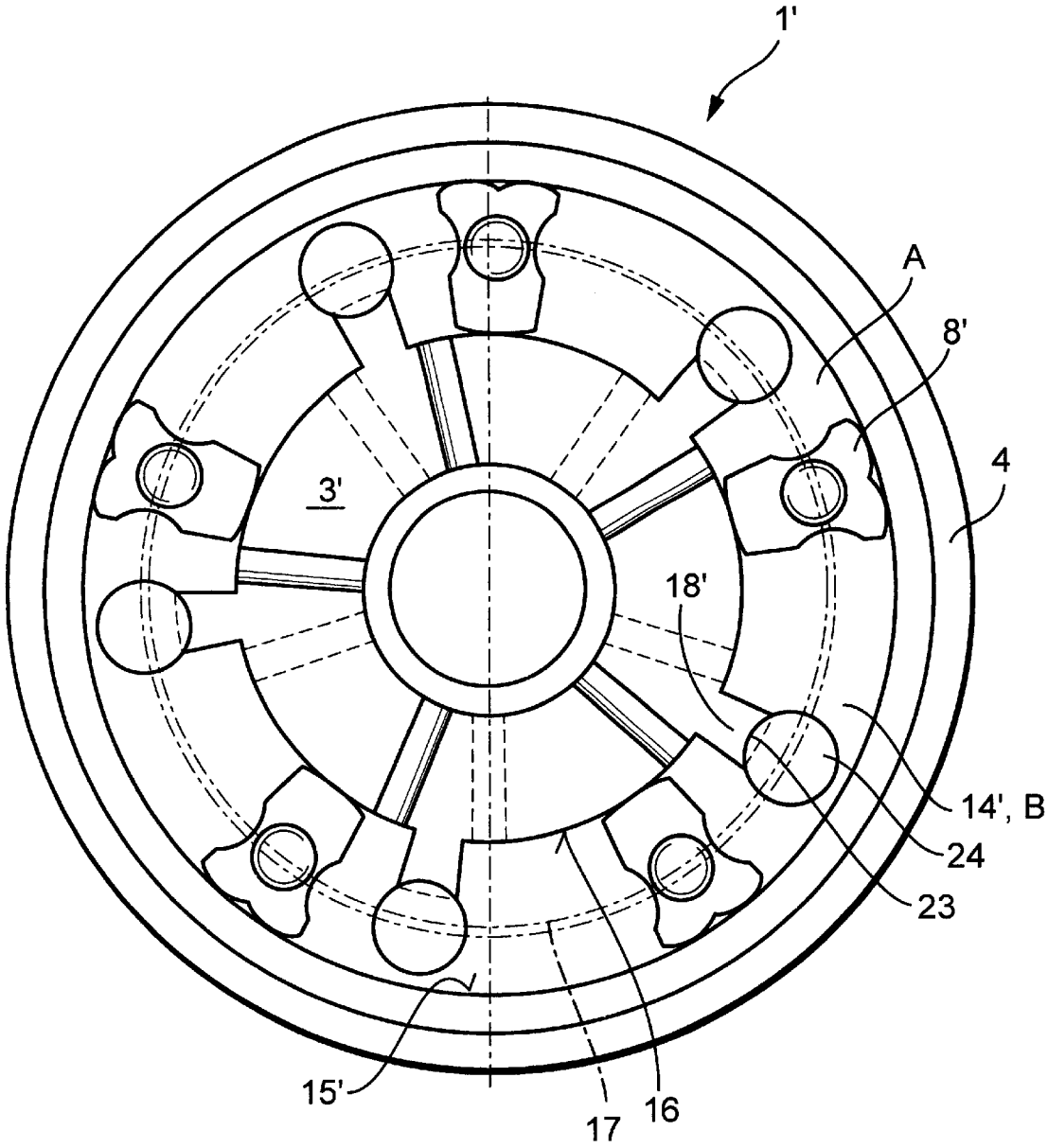
FIG. 4 is a cross-section through a segment-vane adjuster having an outwardly open rotor.

FIG. 4 shows a cross-section through an alternative segment-vane adjuster 1' comprising outwardly open hydraulic chambers 14'. These are closed on the outside by the stator ring 4 which thus forms the outer limiting wall 15'. Separation between the hydraulic chambers 14' is achieved by shortened vanes 18' whose free ends comprise recesses 23 into which rollers 24 are inserted with sealing clearance relative to the stator ring 4. The segments 8' are adapted to the shape of the rollers 24. No relative motion takes place between the segments 8' and the stator ring 4, all of which are a part of the assembled stator. The inclination and the self-locking of the segments 8' is therefore determined only by the pressure difference between the active oil chambers A and B and by the relative motion between the segments 8' and the inner limiting wall 16.

A fixation of the rotor 3 relative to the stator 4 can be effected in the segment-vane adjuster 1, 1' of the invention in the start or in an intermediate position using a common-type axial or radial fixing pin. But it is also conceivable to effect fixation by an axial displacement of the segments 8, 8' into side pockets of the cover 5 or of the drive pinion 6 and a simultaneous radial clamping of the segments 8, 8'.

In the case of the segment-vane adjuster 1' having an outwardly open rotor 3', fixation is also possible by a radial clamping of the segments 8' between the outer limiting wall 15' defined on the stator ring 4 and the inner limiting wall 16 defined on the rotor 3'.

What is claimed is:

1. A rotary piston adjuster for hydraulic phase adjustment of a camshaft of an internal combustion engine relative to a drive pinion, said adjuster comprising a rotor fixed to the camshaft and cooperating with the drive pinion for effecting phase adjustment, wherein annular hydraulic chambers are arranged in a peripheral region of the rotor and comprise an outer and an inner limiting wall and radially extending vanes acting as separating walls, said hydraulic chambers being divided by segments that are axially connected to the drive pinion into active oil chambers A and B with sealing clearance, said hydraulic chambers are selectively loaded by pressure oil, and said segments possess an anti-racing device and an eccentric pivot bearing having radial play.

2. A rotary piston adjuster of claim 1 wherein the segments have a longitudinally symmetrical configuration and possess a plane of symmetry.

3. A rotary piston adjuster of claim 2 wherein the segments comprise two identically shaped cams that are configured as the anti-racing device and are arranged at equal distances to the plane of symmetry on at least one end of the segments, a central cam being arranged on another end of the segments, and upon pivoting of the segments, said cams come into contact with the limiting walls.

4. A rotary piston adjuster of claim 3 wherein the cams have a circular cylindrical contour and a cylinder axis of the contour of the central cam coincides with an axis of pivot of the segments.

5. A rotary piston adjuster of claim 4 wherein normals of lines of contact of the cams with the limiting walls enclose an angle that brings about a self-locking.

6. A rotary piston adjuster of claim 5 wherein the cams and the pivot bearings are disposed outside of a central plane of the hydraulic chambers.

7. A rotary piston adjuster of claim 6 wherein the hydraulic chambers are closed laterally with sealing clearance by a cover and by the drive pinion that is configured as a cover, and the cover and the drive pinion are connected to each other by a stator ring surrounding the rotor and by axle shafts of the pivot bearings.

8. A rotary piston adjuster of claim 7 wherein the axle shafts are configured as through-screws that project through aligned bores of the cover and the drive pinion and brace these with a defined biasing force.

9. A rotary piston adjuster of claim 8 wherein the inner and the outer limiting walls are a part of the rotor.

10. A rotary piston adjuster of claim 8 wherein the outer limiting walls of the hydraulic chambers are formed by the stator ring and free ends of the vanes of the rotor comprise recesses into which rollers are inserted with sealing clearance relative to the stator ring.

* * * * *